United States Patent [19]

Maasberg

[11] 4,237,913

[45] Dec. 9, 1980

[54] HIGH-PRESSURE CONDUIT-CLEANING NOZZLE

[75] Inventor: Wolfgang Maasberg, Duisburg, Fed. Rep. of Germany

[73] Assignee: Woma Apparatbau Wolfgang Maasberg & Co. GmbH, Duisburg, Fed. Rep. of Germany

[21] Appl. No.: 59,120

[22] Filed: Jul. 19, 1979

[30] Foreign Application Priority Data

Jul. 22, 1978 [DE] Fed. Rep. of Germany ... 7822037[U]

[51] Int. Cl.[2] ..... B08B 9/04

[52] U.S. Cl. ..... 134/167 C; 239/DIG. 13

[58] Field of Search ..... 134/22 C, 24, 166 C–168 C; 239/DIG. 13, 548

[56] References Cited

U.S. PATENT DOCUMENTS

| | | | |
|---|---|---|---|
| 1,448,876 | 3/1923 | Sladden | 134/167 C |
| 3,536,263 | 10/1970 | Parker | 134/167 C X |
| 3,678,948 | 7/1972 | Hedges | 134/167 C |
| 3,814,330 | 6/1974 | Masters | 134/167 C X |
| 3,880,176 | 4/1975 | Horne | 134/167 C |
| 4,011,100 | 3/1977 | Ross | 134/24 X |

*Primary Examiner*—Robert L. Bleutge

*Attorney, Agent, or Firm*—Karl F. Ross

[57] ABSTRACT

A conduit-cleaning nozzle mounted via a swivel on the front end of a high-pressure hose has a nozzle body which is elongated along and generally centered on a longitudinal axis. This body has axially tapered front and rear ends and is formed at the rear end with an axial-symmetrical liquid-distribution compartment having at least one backwardly and normally downwardly opening liquid-ejection aperture. Water supplied at high pressure to this compartment is ejected downwardly and backwardly from the aperture. The angular orientation of the aperture is established by an off-center mass which is fixed in the nozzle body and which imparts to it a center of gravity which is offset below its central symmetry axis, so that the nozzle is self-righting.

14 Claims, 4 Drawing Figures

HIGH-PRESSURE CONDUIT-CLEANING NOZZLE

FIELD OF THE INVENTION

The present invention relates to a high-pressure conduit-cleaning nozzle. More particularly this invention concerns such a nozzle used to clean a conduit of a sewage system or the like.

BACKGROUND OF THE INVENTION

My earlier U.S. Pat. Nos. 3,080,265 and 3,380,461 describe a system for cleaning a conduit—an underground pipe or even an open trench—of a waste-disposal system. A nozzle is mounted on the downstream end of a high-pressure conduit. This nozzle has at least one backwardly open water-ejecting aperture. Water supplied under high pressure to this nozzle, therefore, is ejected backwardly to displace the nozzle along in the conduit to be cleaned. As it moves forward the nozzle loosens sludge deposits and the like inside the conduit, in particular on the floor thereof. Backward withdrawl of the nozzle, while still spraying, effectively scoops the loosened deposits up and allows them to be flushed away. Such a system has replaced more complex mechanical scraping devices, as it allows a conduit to be cleaned with a relatively simple tool, and without running the risk of damaging the interior of the conduit.

Many of the known systems have the disadvantage that much of the water sprayed out by the nozzle does not serve for cleaning. Since sewage conduits almost never run completely full, their upper walls and the upper portions of their side walls normally are relatively clean. Thus the high-pressure streams directed against these upper walls serve no function. Closing the apertures directed upwardly has not, however, proven effective, as the nozzle then normally reorients itself with the apertures pointing upwardly, so that none of the apertures is directed at the lower wall. Forming the nozzle of flattened shape will orient it better inside the conduit, but will make passing it around bends or the like somewhat more difficult. What is more, when such a flattened nozzle turns over it is necessary to withdraw the entire nozzle with the hose to reorient it.

OBJECTS OF THE INVENTION

It is therefore an object of the invention to provide an improved nozzle usable in the above-discussed type of system for cleaning a waste-disposal conduit.

Another object is to provide such a nozzle which will be self-righting to direct most of its sprays at the locations where such sprays are most needed.

SUMMARY OF THE INVENTION

These objects are attained according to the instant invention in a conduit-cleaning nozzle having a nozzle body which is elongated along and generally centered on a longitudinal axis and that has axially spaced front and rear ends. This body is formed at the rear end with a liquid-distribution compartment with at least one backwardly open liquid-ejection aperture. Means is provided at this rear end, normally in the form of a simple screw connection, for connecting the nozzle body to a high-pressure hose so as to supply high-pressure liquid from the hose to the compartment for ejection of this liquid backwardly from the aperture. According to this invention the nozzle has a generally offcenter mass in the body which imparts to the nozzle a center of gravity which is offset from the axis. Thus the nozzle will normally position itself with the center of gravity below the axis. When the aperture is similarly provided below the axis, this arrangement will ensure that the aperture will normally be directed downwardly. Even if the nozzle turns over, it will naturally seek to reposition or right itself in the normal position with its center of gravity below its axis. Such a nozzle is mounted on the end of the hose by means of a swivel coupling of the type described in my jointly filed and copending application Ser. No. 059,121.

According to further features of this invention the nozzle body is hollow above the axis and is formed integrally with the offcenter mass below the axis. The distribution compartment at the rear end of this nozzle is, however, axially symmetrical. Even when such a nozzle is forced through a conduit having solid deposits in its base that deflect its path of travel, it will remain in the desired upright orientation.

It is also possible to form the nozzle body with a central throughgoing passage opening backwardly into the rear distribution compartment and opening forwardly at the front end of the nozzle. This passage can be plugged at the front end, or can be used to dispense a small amount of liquid to aid the passage of the nozzle through a conduit to be cleaned.

It is also possible in accordance with this invention to form the nozzle body of a central shaft carrying at its rear end a plate forming with a rear cap the distribution compartment. At its front end the shaft supports a front housing part constituted as a transverse plate from which a sleeve extends axially backwardly and onto the front of which is screwed a front cap. This entire front part is supported rotatably on the shaft so that it can be twisted and rotated on the shaft without interfering with the orientation of the spray from the rear end. The offcenter mass is hung on this shaft and can be arrested at any angular position on it for the appropriate positioning of the apertures. Thus if it is desired to make a pass just aiming a plurality of apertures at one side or the other, or even at the upper wall of the conduit, it is possible to appropriately adjust the mass.

Although such an arrangement is particularly useful when the spray apertures at the rear end of the nozzle are mainly directed downwardly, that is the flow from apertures lying below a horizontal plane including the axis is greater than that from any nozzles above the axis, such an arrangement can be used with nozzles having an array of angularly equispaced apertures with equal all-around flow. In the latter case having a self-righting and self-positioning nozzle prevents the nozzle from rotating unnecessarily as it moves through the conduit to be cleaned.

According to further features of this invention the nozzle is axially symmetrical except for the mass. What is more, it is of central cylindrical shape and is tapered frustoconically at both ends. Thus the nozzle can be fed through even a relatively small conduit, and can work its way through relatively massive deposits of sludge.

SPECIFIC DESCRIPTION

Figure 1:
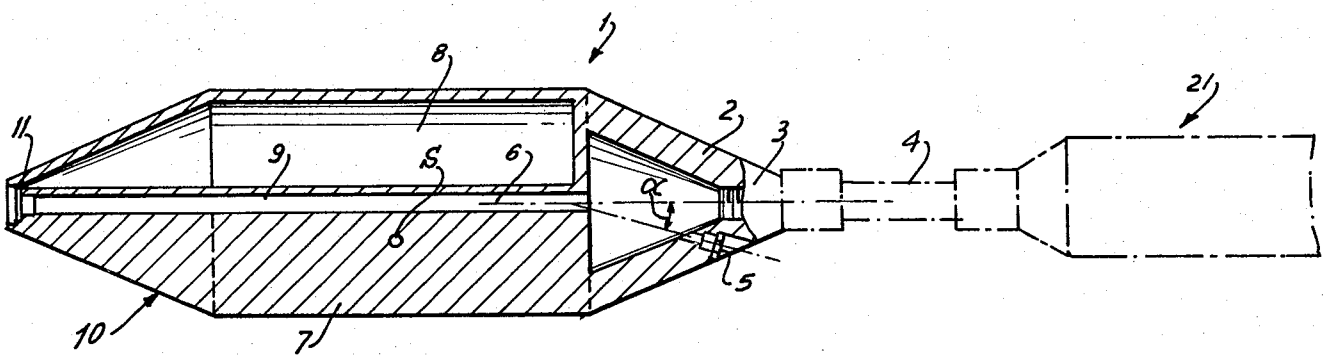
FIG. 1 is an axial section through a nozzle assembly according to the instant invention.

As shown in FIG. 1 a nozzle according to the instant invention has a nozzle body 1 substantially centered on an axis 6 and having at its rear end a liquid-distribution chamber or compartment 2 that is axially symmetrical and that is pressurized through an inlet hole 3 connected via a short length hose 4 to a swivel coupling 21 and thence to a source of a liquid, normally water under high pressure. Further details of the swivel 21 can be obtained from my above-cited and copending jointly filed application. Similarly the flow rates and pressures used are discussed in my above-cited patents.

Figures 2, 3, 4:
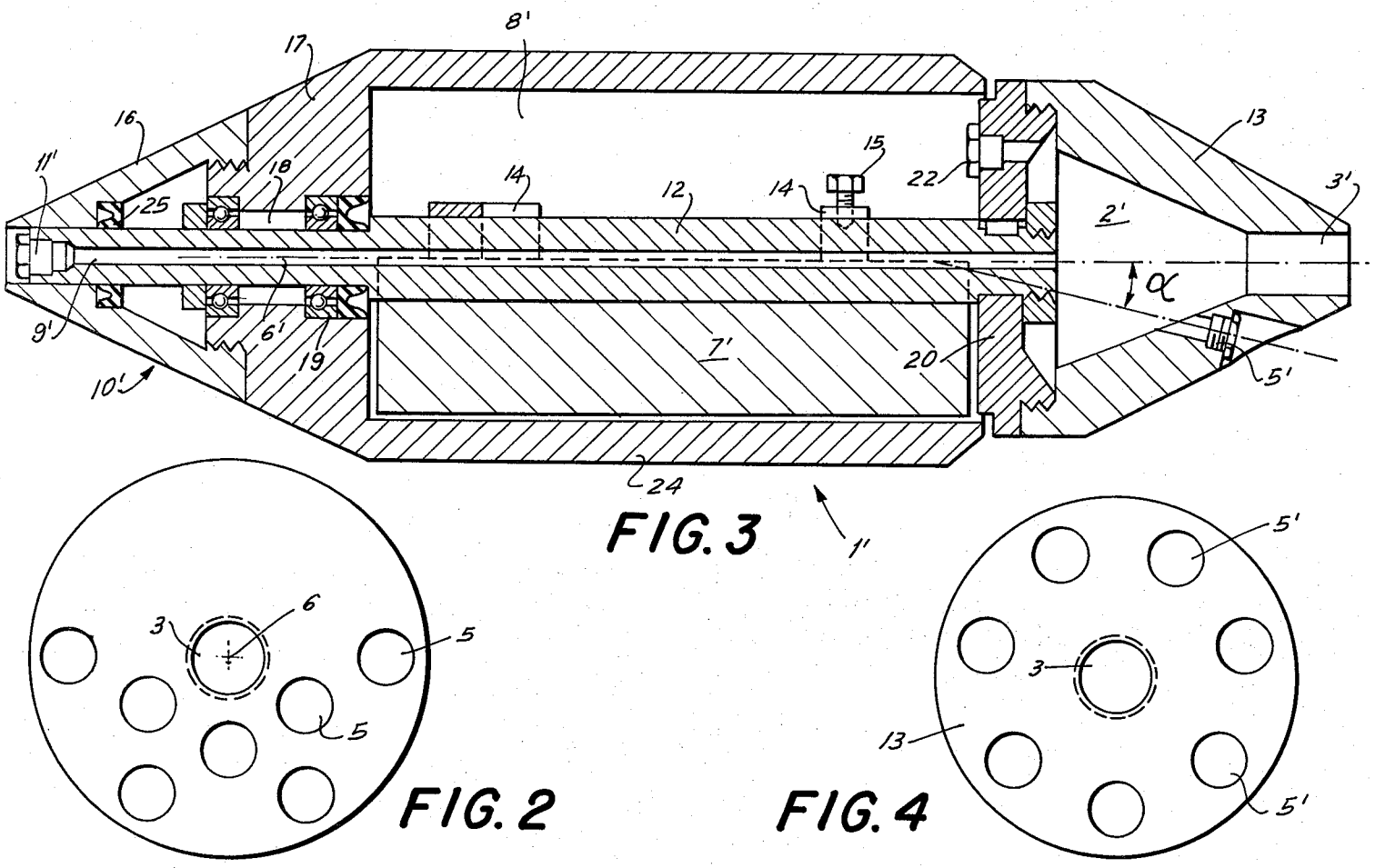
FIG. 2 is a large-scale rear view of a nozzle of the assembly of FIG. 1.
FIG. 3 is an axial section through another nozzle according to this invention.
FIG. 4 is a rear view of the nozzle of FIG. 3.

The nozzle body 1 is axially tapered frustoconically at both ends and is formed at its rear end, as also seen in FIG. 2, with a plurality of backwardly open water-ejecting apertures 5. These apertures 5 lie principally below a horizontal plane including the axis 6, so that the jets of liquid therefrom will be directed principally downward at an angle $\alpha$ of 15° to the axis 6.

According to this invention the cylindrical central portion of the body 1 is formed below the axis 6 as a solid mass 7 having a center of gravity S lying well below the axis 6. Above the axis 6 the nozzle body 1 is formed with a hollow chamber 8. Along the axis 6 the body 1 is formed with an axially throughgoing passage 9 that opens at the frustoconically tapered front end 10 of the body 1. A nozzle tip or screw-closure 11 may be fitted into the front end of this passage 9. Normally a small amount of flow out the front end is advantageous, facilitating moving of the entire nozzle body 1 along through a conduit to be cleaned. In some instances it may be desired, however, to completely block the front end of the passage 9.

The arrangement as shown in FIGS. 3 and 4 is substantially identical. Here a nozzle 1′ is formed as in FIG. 1 with an axially symmetrical distribution chamber 2 which, however, has a plurality of angularly equispaced apertures 5′ spaced around the inlet port 3′. The body 1′ has a central shaft 12 defining an axial passage 9′ centered on the axis 6′ and closed at the front end 10′ with a nozzle or screw closure 11′. A weight 7′ is hung via loops 14 from the shaft 12, and a screw 15 can be used to lock this weight 7′ at any angular position on the shaft 12.

Keyed to the rear end of the shaft 12 is a transverse plate 20 to which is threaded a cap 14 forming the chamber 2′. A nozzle 22 allows water under pressure to pass between the chamber 2′ and the chamber 8′ above the weight 7′ to prevent sludge and other material from getting into and depositing in this chamber 8′. The rear cap 13 can be easily replaced with another cap having only lower apertures such as shown at 5 in FIG. 2.

At its front end the shaft 12 passes through a cylindrical hole 18 in a transverse plate 17 and supports this transverse plate via roller bearings 19. A gland 23 prevents leakage from the compartment 8′ forwardly into the hole 18. The plate 17 is formed with a backwardly extending cylindrical skirt 24 enclosing the weight 7′ and defining the chamber 8′. A cap 16 is screwed to the front of this plate 17 and fits with the gland 25 around the frontmost portion of the shaft 12 to prevent leakage back around this shaft 12. Thus the entire unit constituted by the plate 17, cap 16, and skirt 24 can rotate freely on the shaft 12 to prevent the nozzle from getting caught when passing through a conduit. The rear end cap 13 and associated structures are, rotationally, coupled to the shaft 12 which is angularly fixed to the weight 7′ so that the ejecting apertures 5′ will all be oriented in the desired direction relative to the axis 6′.

The nozzle according to the instant invention can be snaked relatively long distances through a conduit without the operator having to worry that it has turned over and is not functioning efficiently to clean the conduit. At the same time when a rear plate such as shown in FIG. 2 is employed the operators can be certain that most of the water being ejected by this nozzle will be effective against the most heavily fouled portion of the conduit being cleaned. Even if the device has to go around a corner or move up or down in a portion of the conduit being cleaned, proper orientation is assured.

I claim:

1. A conduit-cleaning nozzle comprising:

a nozzle body elongated along and generally centered on a longitudinal axis and having axially spaced front and rear ends, said body formed at said rear end with a liquid-distribution compartment and with at least one backwardly opening liquid-ejection aperture;

means at said rear end for connecting said body to a high-pressure hose for supplying high-pressure liquid from said hose to said compartment for ejection of said liquid backwardly from said aperture;

a generally offcenter mass in said body imparting to said nozzle a center of gravity offset from said axis and wherein said nozzle body is integrally formed with said mass to one side of said axis and is hollow to the other side thereof, said compartment being centered on said axis and generally axis-symetical.

2. The nozzle defined in claim 1 wherein said body is formed with a passage extending along said axis from said compartment to said front end, said passage opening forwardly at said front end, whereby liquid from said compartment can be expelled axially forwardly through said passage.

3. The nozzle defined in claim 1 wherein said body includes a central shaft lying on said axis, said mass being suspended from said shaft.

4. The nozzle defined in claim 3 wherein said body includes a rear body part fixed on said shaft, forming said compartment, and having said means.

5. The nozzle defined in claim 4 wherein said shaft has an axially throughgoing passage opening backwardly into said compartment and forwardly at said front end, said body including a front body part rotatably supported on said shaft.

6. The nozzle defined in claim 5, further comprising means for supporting said mass on said shaft for rotation thereabout, and means for rotationally fixing said mass on said shaft in any of a plurality of angularly offset positions.

7. The nozzle defined in claim 5 wherein said front body part includes a removable cap, said nozzle further comprising bearings rotatably supporting said front part on said shaft.

8. The nozzle defined in claim 5 wherein said rear body part includes a transverse wall fixed on said shaft, and a cap threaded onto said wall and having a threaded axial hole constituting said means.

9. The nozzle defined in claim 1 wherein said front and rear ends are outwardly axially tapered.

10. The nozzle defined in claim 1 wherein said body is formed at said rear end with a backwardly axially open hole constituting said means.

11. The nozzle defined in claim 1, further comprising a swivel coupling connected to said means and connectable to said high-pressure hose.

12. The nozzle defined in claim 1 wherein said aperture is to to the same side of said axis as said center of gravity.

13. The nozzle defined in claim 1 wherein said body is substantially axial symmetrical except for said mass.

14. The nozzle defined in claim 1 wherein said body is formed with an axially extending passage opening rearwardly into said compartment and opening forwardly at said front end.

* * * * *